United States Patent [19]

Takenoya et al.

[11] Patent Number: 4,763,586

[45] Date of Patent: Aug. 16, 1988

[54] DEVICE FOR DETECTING KINDS OF EMBROIDERING FRAMES

[75] Inventors: Hideaki Takenoya; Yoshiaki Ozaki, both of Tokyo, Japan

[73] Assignee: Janome Sewing Machine Co. Ltd., Tokyo, Japan

[21] Appl. No.: 33,033

[22] Filed: Mar. 30, 1987

[30] Foreign Application Priority Data

Apr. 4, 1986 [JP] Japan ..... 61-49833[U]

[51] Int. Cl.[4] ..... D05C 9/04; D05B 21/00

[52] U.S. Cl. ..... 112/103; 112/121.12

[58] Field of Search ..... 112/121.12, 121.11, 112/262.3, 266.1, 262.1, 102, 103, 453, 454, 456, 457, 458

[56] References Cited

U.S. PATENT DOCUMENTS 4,479,446 10/1984 Johnson et al. ..... 112/121.12
4,548,142 10/1985 Peck ..... 112/121.12
4,655,149 4/1987 Szydlek ..... 112/121.12

*Primary Examiner*—Peter Nerbun
*Attorney, Agent, or Firm*—Michael J. Striker

[57] ABSTRACT

In a device for detecting a type of an embroidering frame used an infrared reflection detecting sensor is positioned on the base fixed to the table of the sewing machine and a movable member having pins is provided to move the embroidering frame in the X and Y coordinate directions. A supporter has holes provided at positions corresponding to the infrared reflection sensor which detects the number and positioning of said holes whereas the detected values are inserted into data indicative of the size of the embroidering frame.

2 Claims, 3 Drawing Sheets

DEVICE FOR DETECTING KINDS OF EMBROIDERING FRAMES

BACKGROUND OF THE INVENTION

The present invention relates to a device for detecting kinds of embroidering frames in a sewing machine, in which a fabric to be stitched is moved in accordance with embroidering pattern data which have been stored in a memory, and the embroidering patterns are formed automatically on the fabric with a lot of stitches by a needle moving vertically.

In this kind of conventional sewing machine, positioning data of lots of stitch forming points in response to desired embroidering patterns are stored in a memory means. In accordance with the positioning data, an embroidering frame for holding the fabric is moved, while the patterns are formed with a lot of stitches by a needle moving vertically.

The amount of moving the embroidering frame is determined in accordance with the pattern data. If a machine operator actuated by error, at making pattern data, the embroidering frame in response to the pattern data including positioning data larger than said embroidering frame in the moving amount, the needle would contact the embroidering frame.

SUMMARY OF THE INVENTION

It is an object of the invention to provide an improved device for detecting types of embroidering frames.

The device of the present invention is provided with a stitch forming means which forms stitches on a fabric by a needle and a needle thread loop taking mechanism, a fabric holding means, a driving means which moves the fabric holding means in the X coordinate direction on a base surface of the detecting device and Y coordinate direction transverse with the X coordinate direction, and a control means for said driving means, and wherein the base is furnished with a detecting sensor, the fabric holding means is installed provided with a sensor response part, and the control means includes an initially setting part which initially sets the sensor response part at a position of responding to said detecting sensor, a comparator which inverts a detecting size of the frame data and compares it with pattern sizing data in relation with the pattern data stored in the memory of said control means, and an actuating part which is actuated in response to compared results. The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENT

Figure 1:
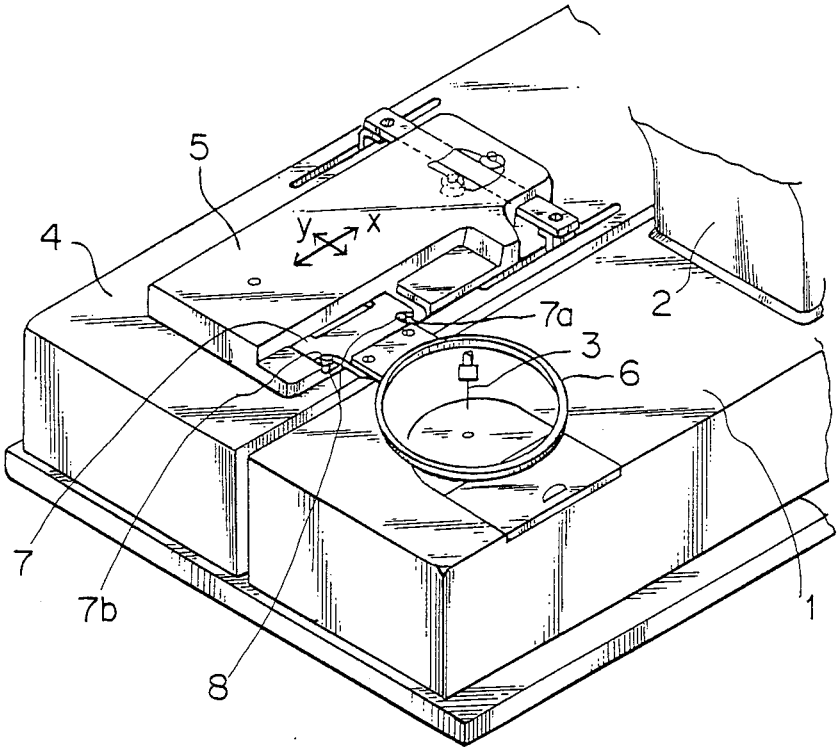
FIG. 1 is a perspective view of a sewing machine incorporated with a frame detecting device.

In FIG. 1, numeral 1 designates a bed of the machine body, from which stand 2 extends. A needle 3 moves vertically with respect to the stand 2. A needle thread loop taking mechanism (i.e. loop taker, conventional but not shown) is provided within the bed 1. The needle 3 and the loop taker cooperate with each other to form stitches.

A base 4 is fixed on the same table as the bed 1. The base 4 has therewithin a driving means (also conventional and) for driving a movable member 5 in the X coordinate direction in parallel with the base 4 and in the Y coordinate direction transverse to the X coordinate direction.

The movable member 5 is provided with two pins 8. A frame 6 is expanded with a fabric thereon and is supported by a supporter 7 having grooves *7a, 7b*. Said two pins 8 are detachably attached to said grooves *7a, 7b*, so that the frame 6 is attached at disposal.

The needle 3 moving vertically and the frame 6 moving in the X and Y coordinate directions form in cooperation embroidered stitches.

Figure 2:
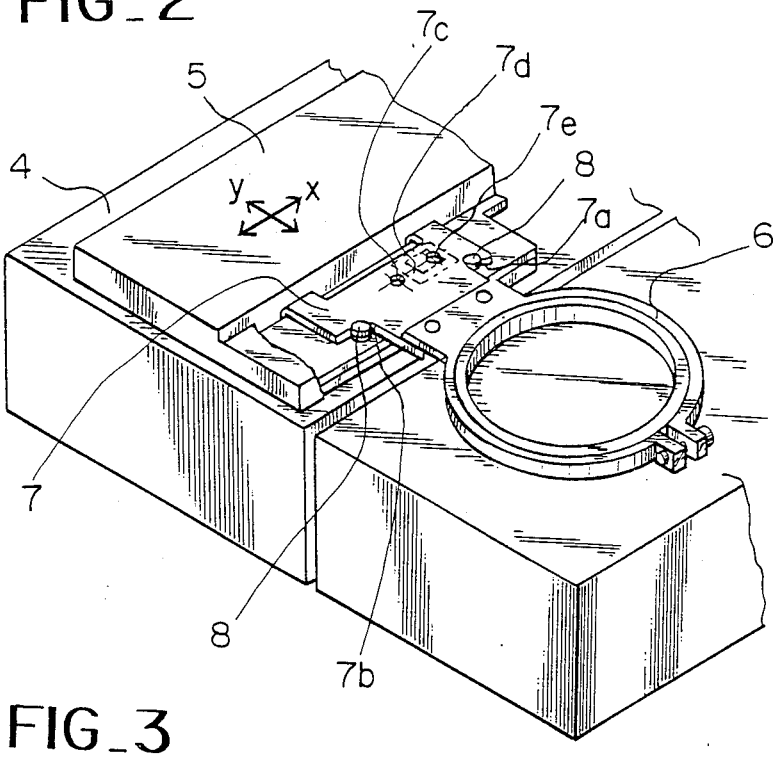
FIG. 2 is a partially enlarged part of the detecting device.
Figure 3:
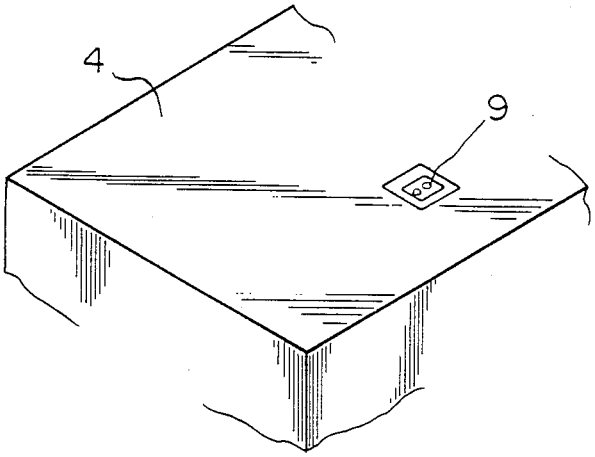
FIG. 3 is a perspective view of providing a detecting sensor.
Figure 4:
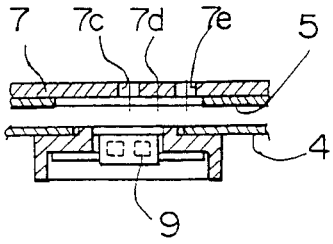
FIG. 4 is a cross sectional view of the above.

The supporter 7 is, as seen in FIGS. 2 to 4, provided with small holes *7c, 7e* at positions corresponding to an infrared reflection sensor 9 secured to the base 4. The small holes may be provided at a position *7d* in dependence upon kinds and sizes of the frame, and the number and positioning of small holes are determined in response to the kind of the frame.

The corresponding position between the small hole and the sensor 9 is set under such a condition that this position responds when the movable member 5 is positioned at both original points of the X and Y direction. The small holes are arranged in the X coordinate direction with reference to the small hole *7c*.

Figure 5:
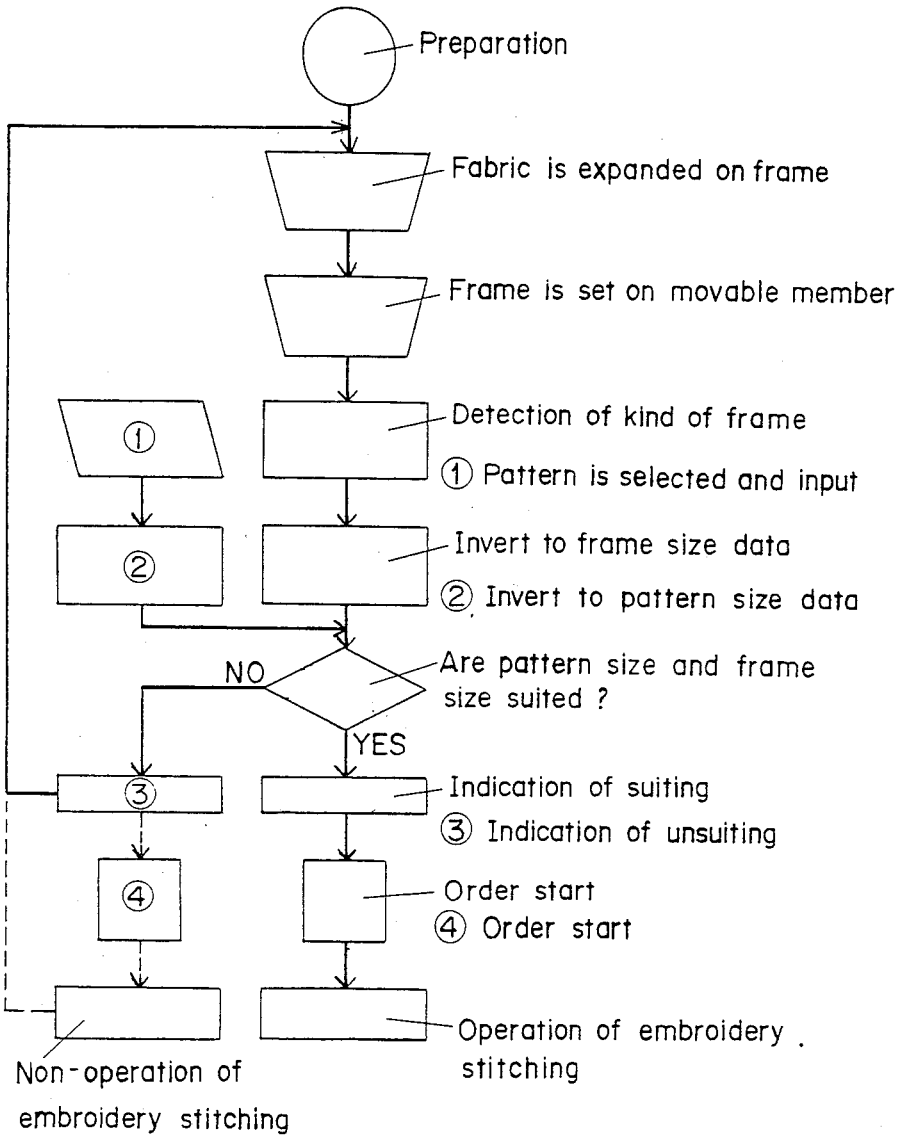
FIG. 5 is a block diagram for explaining detection.

A further explanation will be made to the detection process by means of the frames, as shown in FIG. 5. For the embroidery stitches, the fabric is firstly expanded over the frame 6, and the grooves *7a, 7b* of the supporter 7 securing the frame 6 are engaged with the pins 8 of the movable member 5, so that the frame 6 is integrally attached to the movable member 5.

The member 5 is moved to the both origins of the X and Y coordinate directions. The sensor 9 of the base 4 is in cooperation with the small holes *7c* to *7e* of the supporter 7, and detects the number and positionings of the small holes which are the data of the frame, and the detected values are converted into size data of the frame.

In case, the embroidering frames which have been independently selected and input, are converted into pattern size data, and said embroidering patterns respond to said frame size data, a permission signal for starting the embroidering is issued, and the embroidering is performed by the input of starting order.

On the other hand, when the frame size data do not respond to the pattern size data, a non-permission signal is issued, and even if the starting order is input, the embroidering is rendered inoperative.

In case of an unsuited indication and an inoperation of the embroidering, the size of the pattern is changed, or a frame different in size is used on which the fabric is again expanded, and in the same sequence as above the size of the frame is detected and compared with the pattern size, and a suitable indication is issued and the embroidering is started by the starting order.

In the present embodiment, the infrared reflection sensor 9 is secured to the base for detecting the kind and size of the frame, and is moved in the X coordinate direction for responding to the plurality of small holes, and it is possible to provide a plurality of infrared reflection sensors in response to a plurality of small holes so as to detect the kind and size with reference to the position of the frame supporter. If secured to the base, any sensor means other than the infrared reflection sensor may be employed.

It will be understood that each of the elements described above, or two or more together, may also find a useful application in other types of devices for detecting kinds of embroidering frames differing from the types described above.

While the invention has been illustrated and described as embodied in a device for detecting kings of embrodering, it is not intended to be limited to the details shown, since various modifications and structural changes may be made without departing in any way from the spirit of the present invention.

Without further analysis, the foregoing will so fully reveal the gist of the present invention that others can, by applying current knowledge, radily adapt it for various applications without ommitting features that, from the standpoint of prior art, fairly constitute essential characteristics of the generic or specific aspects of this invention.

What is claimed as new and desired to be protected by Letters Patent is set forth in the appended claims:

1. A device for detecting types of embroidering frames in combination with a sewing machine having a bed for supporting a fabric to be sewn, stitching instrumentalities including a vertically reciprocable needle and a needle thread loop taker cooperating with the needle to form stitches on the fabric, a base positioned adjacent to the machine bed and fixed thereto, a holder for holding the fabric to be sewn on the machine bed, a movable member to which the fabric holder is detachably-attached, the base containing therein a drive mechanism for driving the movable member on the base in the direction of X coordinate and in the direction of Y coordinate transversely of the X coordinate direction, control means for controlling the movement of the drive mechanism to set the movable member to a predetermined position, said detecting device comprising sensor means provided on said fixed base, and response means provided on said fabric holder, said response means being brought to said sensor means and cooperating with said sensor means to indicate the type of the fabric holder when said control means sets said movable member to a predetermined position which is defined by an initial point of said X and Y coordinate directions, where sewing is started.

2. The device as defined in claim 1, wherein said control means is formed to convert a signal from said sensor means into data indicative of a size of said fabric holder and includes a comparator which compares said data with data of an embroidery pattern size.

* * * * *